United States Patent [19]

Sekiguchi et al.

[11] 4,359,290

[45] Nov. 16, 1982

[54] WRITING INSTRUMENT

[75] Inventors: Tomozo Sekiguchi, Kawaguchi; Kazuma Noguchi, Tokyo, both of Japan

[73] Assignee: Pentel Kabushiki Kaisha, Tokyo, Japan

[21] Appl. No.: 155,088

[22] Filed: Jun. 2, 1980

[30] Foreign Application Priority Data

| | | | |
|---|---|---|---|
| Jun. 18, 1979 | [JP] | Japan | 54-83155[U] |
| Aug. 27, 1979 | [JP] | Japan | 54-117710[U] |
| Aug. 27, 1979 | [JP] | Japan | 54-117711[U] |
| Feb. 27, 1980 | [JP] | Japan | 55-24529[U] |

[51] Int. Cl.[3] ..... B43K 23/01; B43K 27/00

[52] U.S. Cl. ..... 401/32; 401/56

[58] Field of Search ..... 401/29, 32, 56, 57

[56] References Cited

U.S. PATENT DOCUMENTS

| | | | |
|---|---|---|---|
| 1,924,256 | 8/1933 | Richards | 401/57 |
| 2,491,254 | 12/1949 | Dorfman | 401/56 |
| 2,492,839 | 12/1949 | Brubaker | 401/56 |
| 2,515,917 | 7/1950 | Votruba | 401/56 |
| 2,518,932 | 8/1950 | Raimondo | 401/56 |
| 2,520,796 | 8/1950 | Bouhier | 401/56 |
| 2,530,674 | 11/1950 | Bergonzo | 401/56 |
| 2,561,509 | 7/1951 | Harris | 401/56 |
| 2,596,234 | 5/1952 | Gardenmann | 401/56 |
| 2,624,312 | 1/1953 | Harris | 401/56 |

FOREIGN PATENT DOCUMENTS

| | | | |
|---|---|---|---|
| 76977 | 11/1948 | Czechoslovakia | 401/32 |
| 955125 | 12/1956 | Fed. Rep. of Germany | 401/32 |
| 49-34188 | 9/1974 | Japan . | |
| 49-34190 | 9/1974 | Japan . | |
| 51-17934 | 5/1976 | Japan . | |

*Primary Examiner*—William Pieprz

*Attorney, Agent, or Firm*—Wenderoth, Lind & Ponack

[57] ABSTRACT

A writing instrument comprises a plurality of slots for holding writing implements such as colored leads, the slots being formed radially in the inner wall of a cylindrical body. The instrument comprises a guide tube mounted coaxially within the cylindrical body and having an opening which can be aligned any one of the slots, a cover plate provided at the opening of the guide tube and adapted to be tilted by the operation of a knock cap, and a chuck provided to the front end of the guide tube. A selected writing implement in the slot is allowed to drop by gravity into the guide tube from the tilted cover plate and then is clamped by the chuck.

20 Claims, 22 Drawing Figures

WRITING INSTRUMENT

BACKGROUND OF THE INVENTION

This invention relates to a multiple slot writing instrument and more particularly a writing instrument which comprises: a plurality of slots for holding writing implements such as colored leads for color pencils or ball-point pens, the slots being formed radially in the inner wall of a cylindrical body; a guide tube mounted coaxially within the cylindrical body and having an opening which can be aligned with any one of the slots; and a chuck fitted at the front end of the guide tube for clamping the writing implement; whereby a selected writing implement in the slot is allowed to drop by gravity into the guide tube through the opening and then is clamped by the chuck, thus permitting the user to write.

The terminology "writing implement" intends to mean colored leads for color pencils and writing elements of ball point pens.

The conventional writing instrument of this kind is known to have a construction such that the opening of the guide tube is made to directly communicate with the slots in turn—which are formed in the inner wall of the cylindrical body—by rotating the guide tube (as in the Japanese Utility Model Publication No. 17934/1976). However, this kind of writing instrument has a disadvantage that during the process of rotating the guide tube to align the opening with a desired slot, other writing implement (i.e., leads) contained in any one of the slots located before the selected one, may drop into the guide tube through the opening, resulting in malfunctions.

To overcome the above-mentioned drawback, various proposals have been made. In one proposal (Japanese Utility Model Publication No. 34188/1974), the writing instrument is provided with a support rod and a release means. The support rod is installed at the upper portion of each slot to press the upper end of the writing implement against the inner wall of the cylindrical body. The release means which is provided to and integrally formed with the upper portion of the guide tube releases the support rod to drop the selected writing implement.

In another proposal (Japanese Utility Model Publication No. 34190/1974), a magnetic pipe which is fitted to the upper end of the writing implement contained in a corresponding slot is attracted by a permanent magnet. In releasing the selected writing implement from the permanent magnet, a ram rod provided to and formed integral with the upper portion of the guide tube is inserted into a through-hole cut through the permanent magnet to push the top of the magnetic pipe away from the permanent magnet.

These constructions, however, are too complicated and therefore stable operation cannot be obtained.

SUMMARY OF THE INVENTION

An object of this invention is to provide a multiple slot writing instrument in which each time the cap is depressed by the user to open or close the chuck, an element provided at the opening of the guide tube is made to open or close that opening, thus avoiding malfunction of the instrument.

Another object of this invention is to provide a multiple slot writing instrument which is simple in construction and provides reliable operation.

Still another object of this invention is to provide a multiple slot writing instrument which, when the writing implements stick together, can easily be recovered to the normal condition.

A further object of this invention is to provide a multiple slot writing instrument which locks the guide tube while the chuck is clamping a writing implement, thereby keeping other writing implements from coming into the guide tube and preventing breakage and sticking together of the writing implements.

Briefly, this invention provides a writing instrument which comprises: a plurality of slots for holding writing implements which and are formed radially in the inner wall of a cylindrical body; a guide tube mounted coaxially within the cylindrical body and having an opening which can be aligned with any one of the slots; a cover plate provided at the opening of the guide tube and adapted to be tilted by the operation of the knock cap; and a chuck provided at the front end of the guide tube; whereby a selected writing implement in a slot is allowed to drop by gravity into the guide tube from the tilted cover plate and then is clamped by the chuck, thus permitting the user to write.

In the writing instrument of this invention, it is desirable that the cover plate have a bent portion at its front end, that the guide tube have openings through which the bent portion is inserted, and that the cylindrical body have receiver chambers provided for corresponding writing implement slots to receive the bent portion of the cover plate that has passed through the opening of the guide tube.

It is also desirable that a projecting member be provided between the inner surface of the rear portion of the cylindrical body and the guide tube so that when the guide tube is in an advanced position and the chuck is clamping a writing implement, the projecting member causes the cover plate to tilt and when the guide tube is in a retracted position and the chuck is not clamping the implement, it causes the cover plate to assume the original horizontal position.

BRIEF DESCRIPTION OF THE DRAWINGS

FIGS. 17 and 18 are cross-sectional views of still another embodiment, with FIG. 17 showing the writing implements in the correct positions, while FIG. 18 shows one of the writing implements that stick together being removed;

DETAILED DESCRIPTION OF THE INVENTION

Figure 1:
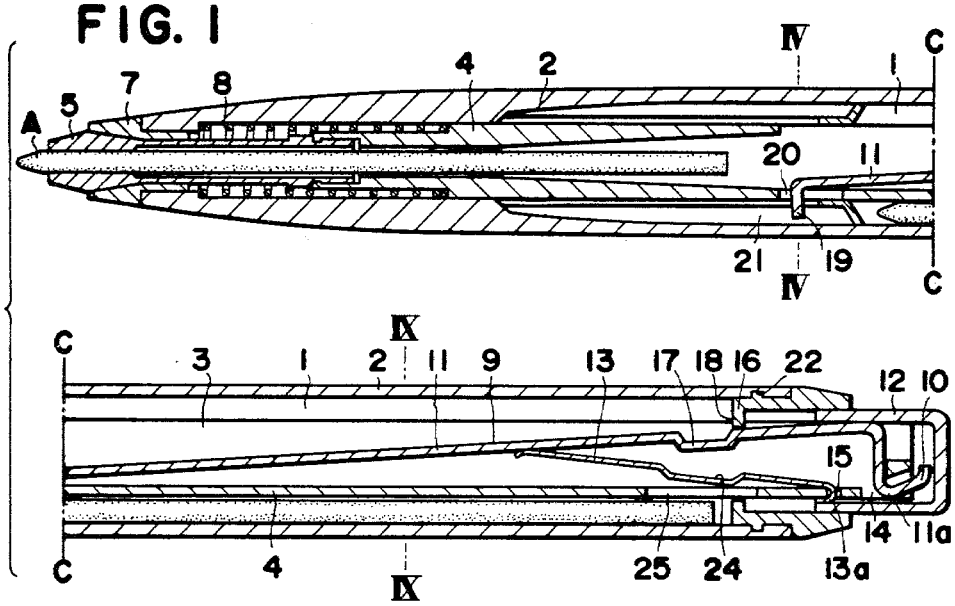
FIG. 1 is a cross-sectional view of one embodiment of this invention showing the chuck clamping the writing implement; (i,e., colored lead)

In the drawings, identical members are denoted by the same reference numerals. Writing implements such as colored leads A are contained in slots 1 which are formed radially in the inner wall of cylindrical body 2 of the writing instrument. Mounted coaxially within the cylindrical body 2 is a guide tube 4 for guiding the lead A and which has an opening 3 through which it can communicate with any one of the slots 1, so that when the user writes using this instrument, the writing lead A desired is allowed to drop by gravity from the slot 1 through the opening 3 into the guide tube 4 and then is gripped by a chuck 5 fitted in the front of the guide tube 4.

Applying an axial pressing force from behind the guide tube 4 coaxially disposed within the cylindrical body 2 causes the guide tube 4, together with the chuck, 5 to be guided to advance against the force of spring 8 resting on the inner shoulder of a metal tip 7 provided at the front end of the body 2. The chuck 5 opens by its own elasticity as it advances from the metal tip 7. When the pressing force is removed, the guide tube 4 and the chuck 5 are retracted by the spring 8 and the chuck 5 is closed by the metal tip.

This writing instrument also has a cover plate 11 which has a slender body portion 9 for closing the opening 3 of the guide tube 4 and an arm portion 10 formed integral with the body portion 9 for receiving the axial pressing force.

Whether the chuck 5 is clamping the lead A (FIG. 1) or not (FIG. 2), the force for elastically pressing the chuck 5 against the metal tip 7 is produced by the spring 8 interposed between the cylindrical body 2 and the guide tube 4. For the guide tube 4 to be able to be pushed forward against the force of the spring 8, a cap 12 is slipped over the rear end of the guide tube 4. An external force applied to the cap 12 is directly or indirectly transmitted to the guide tube 4 causing it to move along the axis of the cylindrical body.

Figure 2:
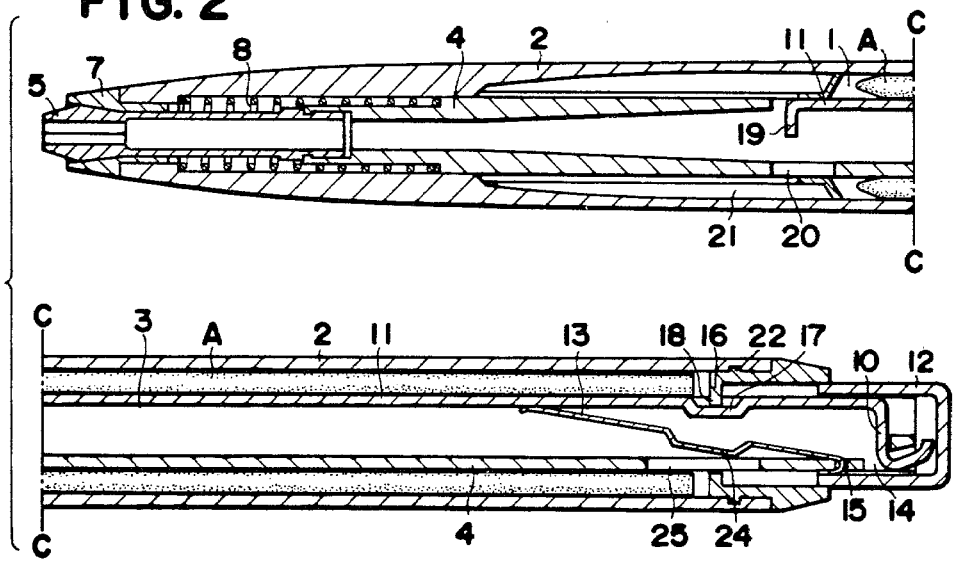
FIG. 2 is a cross-sectional view showing the chuck not clamping the writing implement.

The opening 3 is completely closed, as shown in FIG. 2, by the cover plate 11, a leaf spring 13 that imparts a recovering force to the cover plate 11, and the cap 12. The cover plate and the leaf spring have U-shaped base portions 11*a*, 13*a* which are inserted into openings 14, 15 which are formed in the rear portion of the guide tube 4 on the side opposite to the opening 3, with the cap 12 fitted over the rear end of the guide tube 4.

Though not shown, it will easily be understood that the position of the guide tube 4, with the chuck 5 open to release the writing lead A, is displaced further toward the left than as shown in FIG. 1 in which the chuck 5 clamps the writing lead A. With the chuck 5 closed by the metal tip 7, the guide tube 4 assumes the position, shown in FIG. 2, which is further toward the right than that in FIG. 1.

In order to prevent rotation of the guide tube 4 when positioned as shown in FIG. 1 and to permit its rotation when positioned as shown in FIG. 2, the writing instrument of this invention has the following construction.

That is, between the inner surface of the rear portion of the cylindrical body 2 and the guide tube 4 is provided of projecting member 16 having a projection 18. The cover plate 11 has an engagement portion 17 near the rear end for cooperative engagement with the projecting member 16 and at the front end a bend 19. The guide tube 4 has openings 20 formed therein to receive the bend 19 when the cover plate 11 tilts by the cooperative action between the projecting member 16 and the engagement portion 17 of the cover plate 11. Formed along the inner circumferential surface of the cylindrical body 2 are receiver chambers 21, provided one for each slot 1, for receiving the bend 19 that has passed through the opening 20.

The writing instrument with a construction described above works as follows. When the chuck 5 clamps the writing implement (i.e., lead A) and the guide tube 4 is positioned as shown in FIG. 1, the projecting member 16 and the engagement portion 17 of the cover plate 11 cooperate so as to tilt the cover plate 11, with the result that the bend 19 passes through the opening 20 and into the receiver chamber 21. Once the bend 19 enters the receiver chamber 21, the guide tube 4 cannot be turned. On the other hand, when the chuck 5 is closed and the guide tube 4 assumes the position as shown in FIG. 2, the cooperative relationship between the projecting member 16 and the engagement portion 17 as shown in FIG. 1 no longer exists, releasing the bend 19 from the receiver chamber 21 to allow the guide tube 4 to be rotated.

In the above embodiment, the engagement portion 17 of the cover plate 11 is formed as a depression and the projecting member 16 that cooperates with the engagement portion 17 has its projection 18 protruding into the opening 3 of the guide tube 4. Thus, with the guide tube 4 located as shown in FIG. 1, the projecting 18 abuts against the cover plate 11 causing the plate 11 to tilt downwardly toward the front. With the guide tube 4 retracted to the position as shown in FIG. 2, the projection 18 is situated at the depressed portion causing the cover plate 11 to return to its original horizontal position.

In this way, the construction in which the projection 18 projects into the opening 3 permits relative longitudinal displacement of the guide tube 4 with respect to projecting member 16. To allow rotation of the guide tube 4 relative to the cylindrical body 2, it is necessary to rotatably fit the projecting member 16 into a groove 22 formed in the inner surface of the rear portion of the cylindrical body 2.

Figure 5:
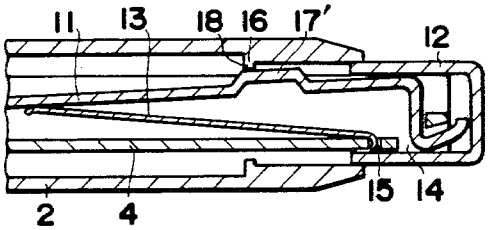
FIG. 5 is a partial cross-sectional view of a modified embodiment of FIG. 1.

The engagement portion 17 of the cover plate 11 may be raised rather than depressed, as shown at 17' in FIG. 5, so that the projecting 18 of the projection member 16 that cooperates with the raised engagement portion 17' can be kept from projecting into the opening 3 of the guide tube 4. The projecting member 16 of FIG. 5 may be formed as an annular projection which is integral with the inner surface of the cylindrical body 2. In this case, the relative rotation between the guide tube 4 and the cylindrical body 2 can be obtained by dividing the cylindrical body into two sections and rotatably connecting the two sections, with the front section secured to the guide tube 4 so as to make them rotate together.

Figure 3:
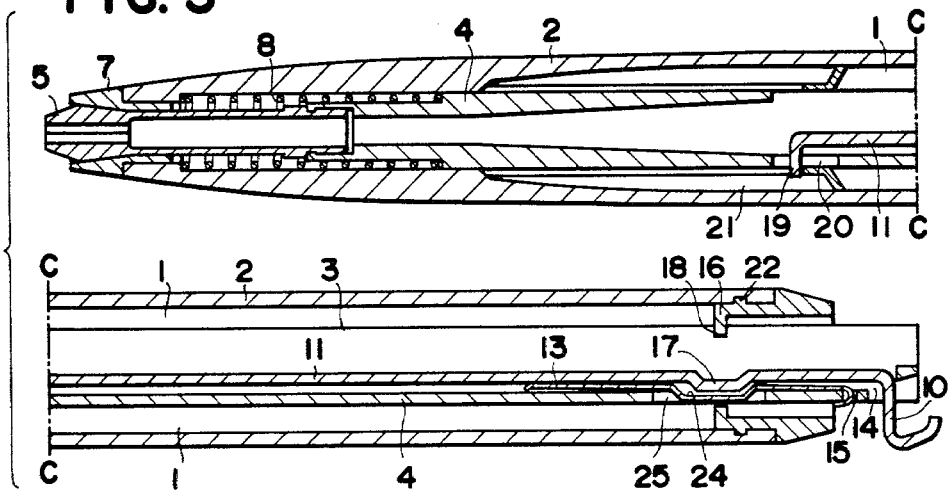
FIG. 3 is a cross-sectional view with the knock cap taken out.
Figure 4:
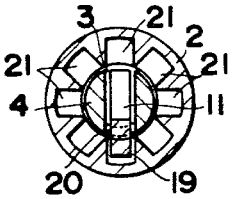
FIG. 4 is a cross-sectional view taken along the line IV—IV of FIG. 1.

In the preceding embodiment (FIGS. 1 to 3) with the depressed engagement portion 17 of the cover plate 11, when the cap 12 is drawn out, the cover plate 11 and the leaf spring 13 are rendered unsupported and fall onto the inner bottom furface of the guide tube 4, thus forming a large space at the rear end of the writing instrument through which to refill spare leads. As can be seen from FIG. 3, the openings 14, 15 through which the base portions of the cover plate 11 and the leaf spring 13 are inserted are located outside the cylindrical body 2 so that the cover plate 11 and the leaf spring 13 will fall onto the inner bottom surface of the guide tube 4 when the cap 12 is taken out. In order to reduce the height of the cover plate 11 and leaf spring 13 when lying on the inner bottom surface of the cylindrical body 2, the leaf spring is formed with a depressed portion 24 which receives the downwardly projecting engagement portion 17 of the cover plate 11, and the guide tube 4 is formed with an opening 25 to receive these downwardly projecting portions. This enables smooth insertion of refill leads. The above construction is superior in this respect to that with the raised engagement portion 17' as shown in FIG. 5.

As can be seen from the above-mentioned embodiments, while the writing lead A is clamped by the chuck 5, the cover plate 11 is tilted by the action of the projecting member 16, and the bend at the front end of the cover plate 11 passes through the opening 20 and into the receiving chamber 21, thus securely holding the guide tube 4 against rotation. This prevents two or more writing leads from being fed to the guide tube, which in turn prevents the clogging of the guide tube and breakage of the lead. When the writing lead A is released from the chuck 5, it can reliably be returned to the associated vacant slot 1. Thus, when the chuck 5 without the lead is retracted, the guide tube 4 is unlocked and free to rotate, thus enabling the user to rotate the guide tube 4 to align the opening 3 with any slot where a desired writing lead is contained. This construction excludes erroneous operations and difficulties.

Figure 6:
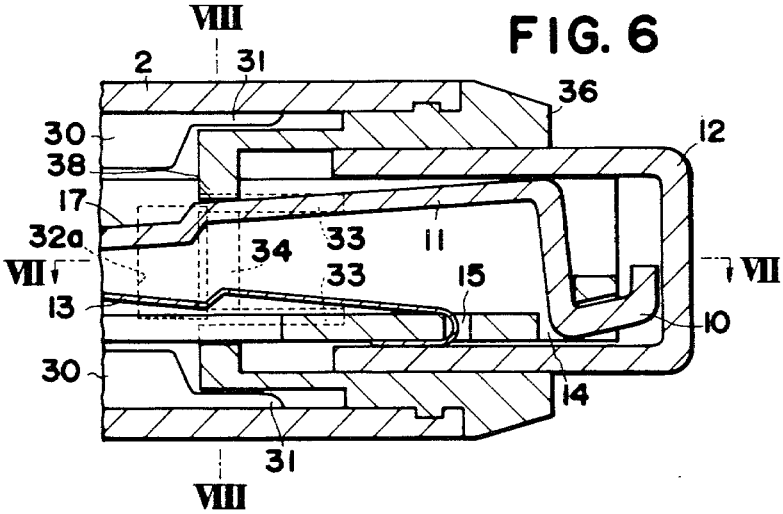
FIG. 6 is a partly enlarged cross-sectional view of FIG. 1 according to a modification.
Figure 7:
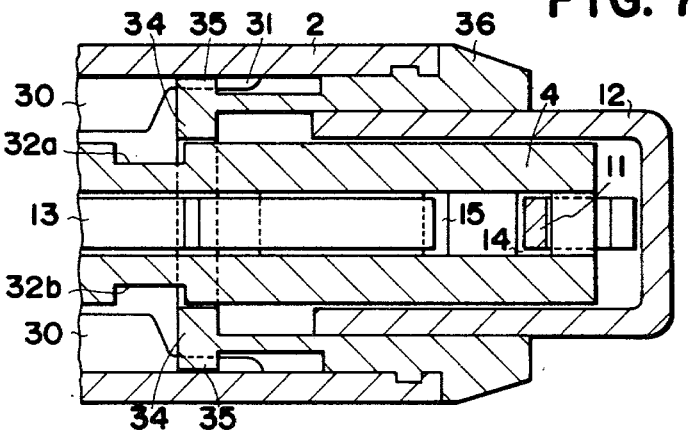
FIG. 7 is a cross-sectional view taken along the line VII—VII of FIG. 6.
Figure 8:
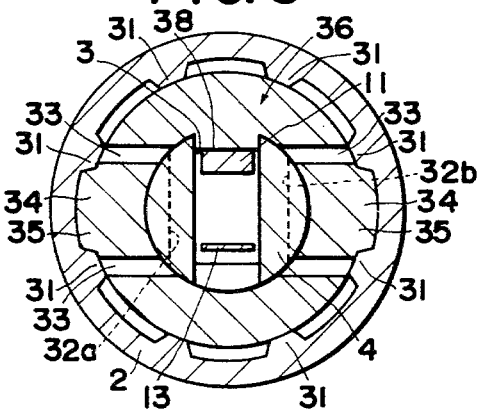
FIG. 8 is a cross-sectional view taken along the line VIII—VIII of FIG. 6.
Figure 9:
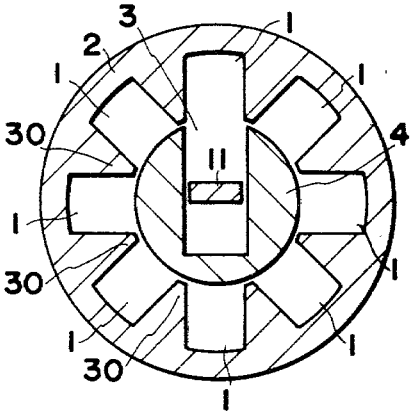
FIG. 9 is a cross-sectional view taken along the line IX—IX of FIG. 1 according to this modification.
Figure 10:
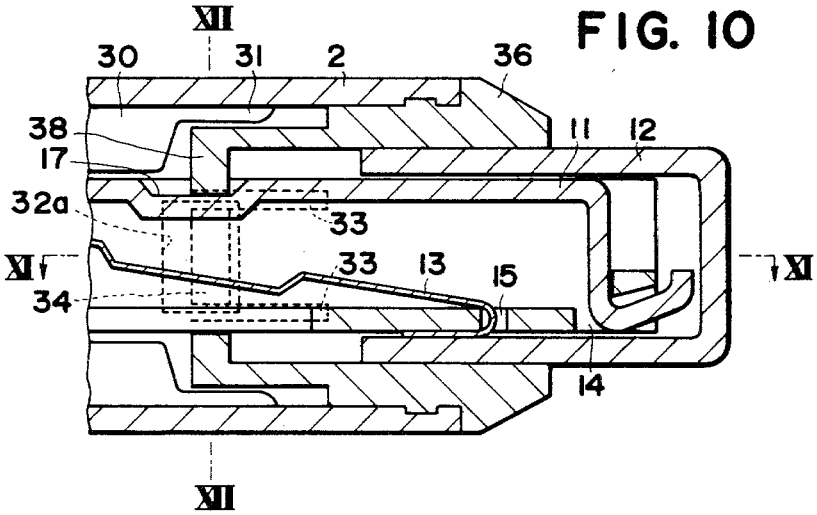
FIG. 10 is a partly enlarged cross-sectional view of FIG. 2 according to this modification.
Figure 11:
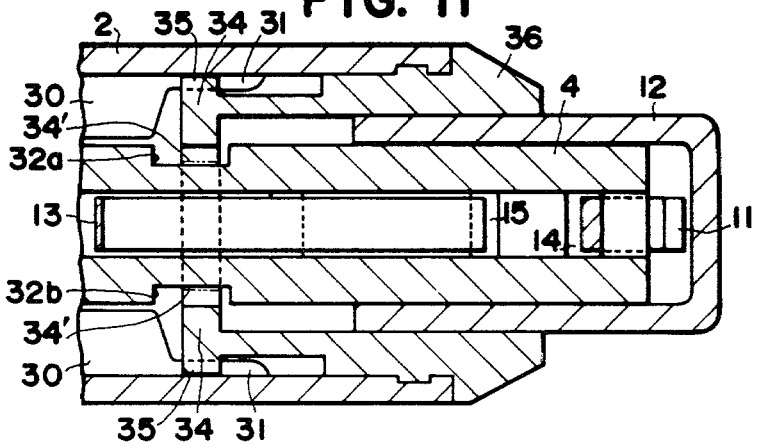
FIG. 11 is a cross-sectional view taken along the line XI—XI of FIG. 10.
Figure 12:
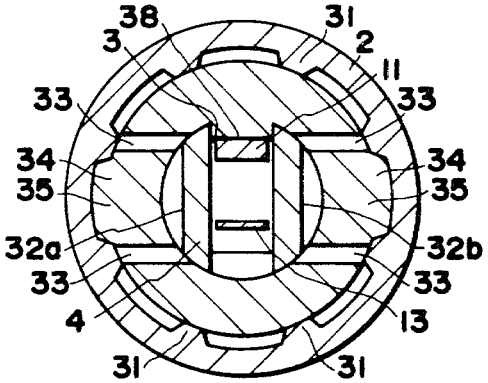
FIG. 12 is a cross-sectional view taken along the line XII—XII of FIG. 10.
Figure 13:
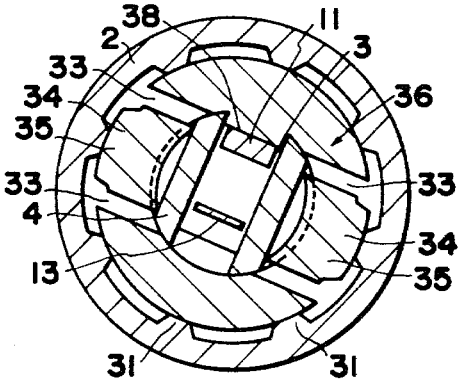
FIG. 13 is a cross-sectional view showing a guide tube being rotated.

There will now be explained a modification of the lock means for the guide tube with reference to FIGS. 6 through 13. FIG. 6 shows the cap and associated elements as illustrated in FIG. 1, but of this modification; FIG. 7 shows the cross section taken along the line VII—VII of FIG. 6; FIG. 8 shows a cross section taken along the line VIII—VIII of FIG. 7; FIG. 9 shows a cross-section taken along line IX—IX of FIG. 1, but of this modification; FIG. 10 shows the cap and associated elements as illustrated in FIG. 2, but of this modification; FIG. 11 shows a cross section taken along the line XI—XI of FIG. 10; and FIG. 12 shows a cross section taken along the line XII—XII of FIG. 10. In these figures, formed on the inner surface of the cylindrical body 2 at equal intervals are sub-partition walls 31 provided for corresponding partition walls 30 defining the slots 1. The guide tube 4 is partially cut on each side surface to form engagement grooves 32*a*, 32*b*. Rotatably fitted in the cylindrical body 2 is an annular control member 36 having movable pieces 34 which can be moved inwardly in a gap 33 formed between the sub-partition walls and the guide tube 4 and each of which has a raised portion 35 formed on the external surface. The raised portion 35 can be received in the recessed portion between two adjacent sub-partition walls 31.

Suppose the engagement grooves 32*a*, 32*b* of the guide tube 4 are partially overlapped with or otherwise completely separated from the movable pieces 34 of the annular control member 36, as shown in FIG. 7, with the chuck 5 clamping the writing implement A. In this case, the inward displacement of the movable pieces 34 is prevented by the external surface of the guide tube 4 so that when the user attempts to rotate the guide tube 4, the raised portions 35 of the movable pieces 34 cannot ride over the sub-partition walls 31 and thus the guide tube cannot be rotated.

Suppose the engagement grooves 32*a*, 32*b* are completely overlapped with the movable pieces 34 as illustrated in FIG. 11, with the chuck 5 not clamping the writing lead A (FIG. 2). In this case, since the movable pieces 34 can be displaced inwardly until they abut against the bottom surface of the grooves 32*a*, 32*b*, the raised portions 35 of the movable pieces 34 can ride over the sub-partition walls 31, thus allowing the guide tube to be rotated (Refer to FIG. 13.)

To permit the guide tube 4 to be rotated by external operation, the annular control member 36 in the above embodiment (FIGS. 6 through 13) is formed as a so-called breechblock rotatably fitted in the rear end of the cylindrical body 2 and is provided with a projection 28 projecting into the opening 3 of the guide tube 4. Thus, by turning the bleechblock 36 the guide tube 4 can be rotated. The sub-partition walls 31 are formed on the rear side of the writing lead slots 1.

Figure 14:
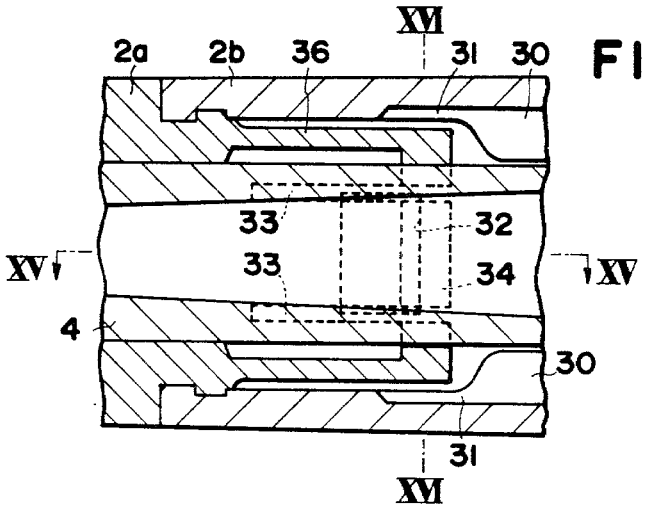
FIG. 14 is a partial cross-sectional view showing another embodiment of this invention.
Figure 15:
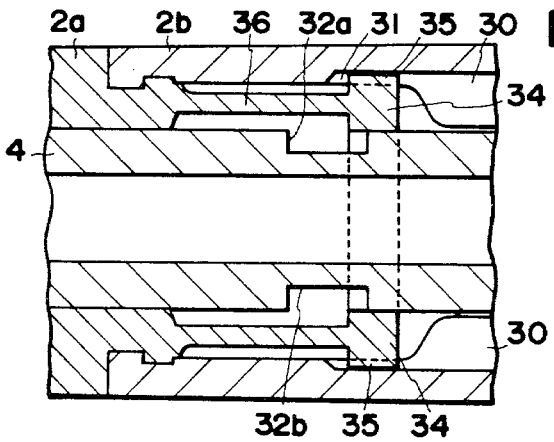
FIG. 15 is a cross-sectional view taken along the line XV—XV of FIG. 14.
Figure 16:
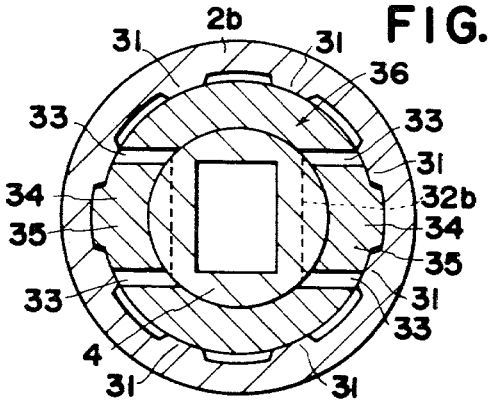
FIG. 16 is a cross-sectional view taken along the line XVI—XVI of FIG. 14.

Still another embodiment of the lock means for the guide tube 4 will be described with reference to FIGS. 14 through 16. Where the cylindrical body 2 is divided into two parts, i.e. front and rear sections 2*a*, 2*b* which are rotatably connected with each other (in the case of the construction of FIG. 17, for example), the annular control member 36 is made integral with the front section 2*a* of the cylindrical body 2 so that the guide tube 4 can be turned by rotating the front section 2*a* which is connected through the compression spring 8 with the guide tube 4. In this case, the sub-partition walls 31 are provided in the rear section 2*b* in front of the writing lead slots 1. The action of this embodiment when the chuck 5 is clamping or not clamping the writing lead A is not described here because if the relation in position between the engagement grooves 32*a*, 32*b* of the guide tube 4 and the movable pieces 34 of the annular control member 36 is made equal to that in the preceding embodiment, the same result can be obtained.

In addition to the actions described above, the projection 38 of the annular control member 36 has the following functions: it cooperates with the engagement portion 17 formed on the cover plate 11 to tilt the cover plate 11 and open the writing implement slot 1 when the guide tube 4 is positioned as shown in FIG. 1 with the chuck 5 clamping the writing lead A; and when the guide tube 4 is positioned as shown in FIG. 2 with the chuck 5 not clamping the writing lead A, it allows the cover plate 11 to be reset to its original horizontal position and closes the writing implement slot 1. In this case, the cover plate 11 may also be tilted by the cap 12 pressing the base portion 10 of the cover plate 11 rather than by the cooperative action between the projection 38 and the engagement portion 17.

The action of the embodiments shown in FIGS. 6 through 16 may be summarized as follows: with the chuck 5 clamping the writing lead A the engagement grooves 32*a*, 32*b* are partially overlapped with or completely separated from the movable pieces 34, as shown in FIG. 7, thus blocking the inward displacement of the movable pieces 34, so that the raised portions 35 cannot ride over the sub-partition walls 31 and the guide tube 4 is locked against rotation. The guide tube 4 can also be locked when the cover plate 11 is pressed down by a writing lead A being locked or stalled thereon.

With the chuck 5 not clamping the writing lead A the grooves 32*a*, 32*b* and the movable pieces 34 are in a complete overlapping relationship, allowing the inward displacement of the movable pieces 34, so that the raised portions 35 can ride over the sub-partition walls 31, thus permitting the free rotation of the guide tube.

When the writing lead slot 1 is not correctly aligned with the opening 3, the movable pieces 34' assume the position indicated by the two-dot line in FIG. 11 with respect to the engagement grooves 32*a*, 32*b*, by raised portions 35 being forced inwardly by walls 31. If in this condition the cap 12 is depressed, the guide tube 4 cannot be pushed forward because the movable pieces 34' engage with the grooves 32*a*, 32*b*. By this the user can recognize that the writing lead slot 1 and the opening 3 are not correctly aligned. Although in the above embodiment, two movable pieces 34 have been provided, the same result can be obtained by using only one movable piece and one engagement groove.

A further embodiment of this invention will be described in the following with reference to FIGS. 17 and 18. The cylindrical body 2 consists of a front cylindrical body 2*a* and a rear cylindrical body 2*b* which is rotatable relative to the front cylindrical body 2*a* and which has writing lead slots radially formed along the inner wall. Provided inside the cylindrical body 2 are a guide tube 4 having the chuck 5 at the front end and a spring 8 which urges the guide tube 4 rearwardly so as to bring the outer surface of the chuck 5 into engagement with the tip 7 of the cylindrical body 2. The guide tube 4 has a single opening 3 formed therein. When the opening 3 opposes one of the writing lead slots 1, the remaining slots are closed by the external surface of the guide tube 4. This mechanism is the same as that in the preceding embodiments.

The cover plate 11 at the opening 3 is assembled into the guide tube 4 in a manner described below. The guide tube 4 has an opening 40 formed at the bottom of the rear portion on the side opposite to the opening 3. The base portion 10 of the cover plate 11 is bent in a trapezoidal shape. A vertical free end 10*a* of the trapezoidal base portion 10 is inserted into the opening 40 and the cap 12 is fitted over the base portion 10 of the cover plate 11 to hold a lower side 10*b* of the trapezoid between the guide tube 4 and the cap 12. Then, the opening 3 is completely closed by the cover plate 11. A bent and projecting portion 10*c* of the cover plate 11 bears against the inner surface of the rear end of the cap 12, and when depressed the cap 12 causes the front end 9 of the cover plate 11 to move down. Pressing the cap 12 hard not only tilts the cover plate 11 but also compresses the spring 8 to advance the guide tube 4 thus, releasing the chuck 5.

The cap 12 serves to hold in correct position not only the cover plate 11 but also the leaf spring 13 which imparts a recovering force to the cover plate 11. That is, the base portion 13*a* of the leaf spring 13 that is bent in U shape is inserted through the opening 40, and the base end 13*b* of the leaf spring 13 is held between the guide tube 4 and the cap 12. It is of course possible to form two separate openings 14, 15 in the guide tube 4 as in FIG. 1. Furthermore, the base end 13*b* of the leaf spring 13 is held in place by a ring 42 which is slidably installed into a groove formed in the inner surface of the cap 12. Thus the ring 42 can be maintained at a relatively stationary position whether the cap 12 is advanced or retracted.

Figure 18:
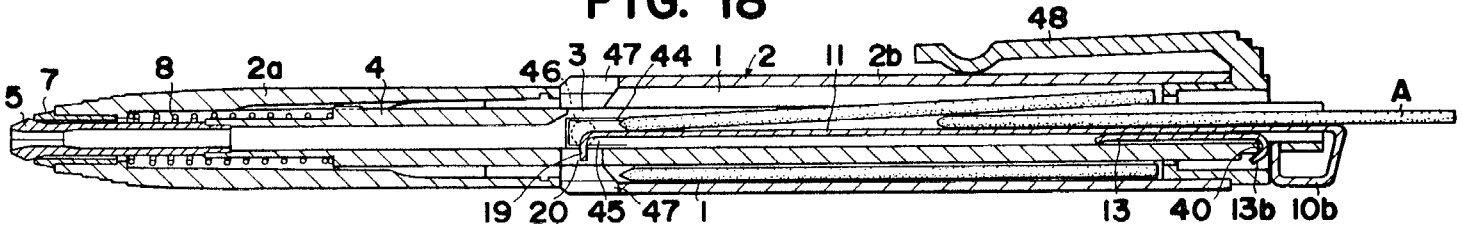

With the above construction, if two writing leads should enter the guiding passage in a manner interfering with and obstructing each other at the front end of the inclined cover plate 11, one of them can smoothly be drawn out from the rear end of the writing instrument by pulling out the cap 12 as shown in FIG. 18.

Figure 17:
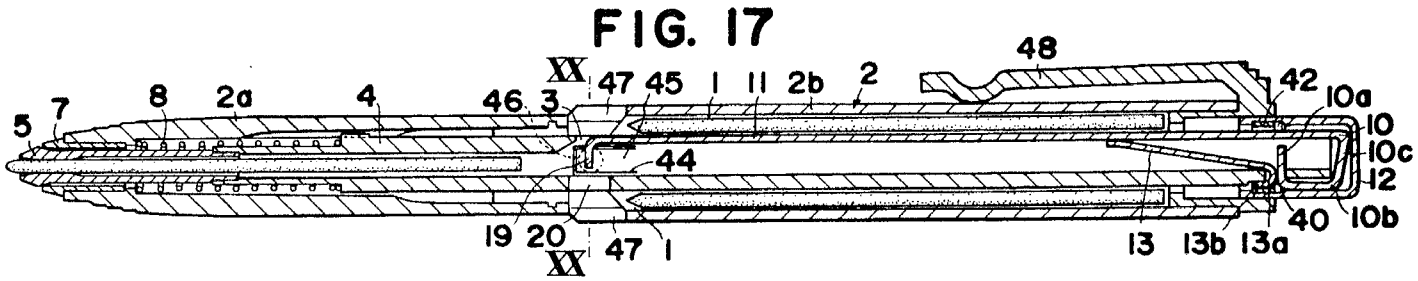
Figure 19:
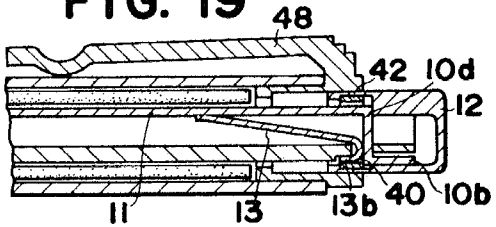
FIG. 19 is a partial cross-sectional view showing a modified embodiment of FIG. 17.

A modification of the above embodiment of FIG. 17 is shown in FIG. 19. The construction of FIG. 19 differs from that in FIG. 17 in the following points. In FIG. 17 the trapezoidally bent base portion 10 of the cover plate 11 is inserted through the opening 40 from outside, enclosing the rear end of the guide tube, whereas in FIG. 19 the base portion of the cover plate 11 is formed into an L-shape and is inserted through the opening 40 from inside. Therefore, in FIG. 17 the lower side 10*b* of the base portion is located behind the vertical free end 10*a* while in FIG. 19 the lower side 10*b* is formed as the free rear end. Furthermore, in FIG. 17 it is the projecting bent portion 10*c* on the side of the opening 3 that bears against the inner surface of the rearmost portion of the cap 12 while in FIG. 19 it is a bent portion 10*d*. Although there are differences between the two constructions, they are identical in that both the lower side 10*b* of the bent base of the cover plate 11 and the base end 13*b* of the leaf spring 13 are held between the guide tube 4 and the cap 12 fitted over the rear end of the guide tube 4.

Figure 20:
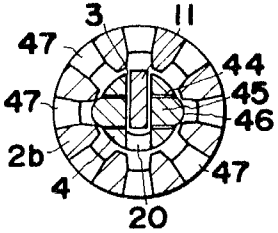
FIG. 20 is a cross-sectional view taken along the line XX—XX of FIG. 17.

Referring to FIG. 17 and FIG. 20, which shows a cross section taken along the line XX—XX of FIG. 17, the guide tube 4 is formed with almost U-shaped slits 44 to impart elasticity to portions 45, each of which has a projection 46. The projections 46 are adapted to engage with through-holes 47 which are cut through the rear cylindrical body 2*b* and which correspond to respective writing lead slots 1. The projections 46 serve to align the opening 3 of the guide tube 4 with the desired writing implement slot 1 and to hold the guide tube in a desired position. The through-holes 47 can cooperate with through-holes 20 formed in the guide tube 4 to receive the bent portion 19 at the tip of the cover plate 11 and also to remove pencil lead powder caused from wear. Reference numerals 7 and 48 denote a metal tip surrounding the chuck 5 and a clip fitted to the rear end of the rear cylindrical body 2*b*.

In the preceding embodiments the cylindrical body 2 may be formed of transparent material. This permits the user to recognize from outside the color of the writing implements contained in the slots 1. In using this type of writing instrument, the user first turns the guide tube 4 equipped with the cover plate 11 to align the tube opening with the slot in which a desired writing implement is contained and then causes the guide tube 4 to advance against the force of the spring 8, with the chuck 5 facing downward. This causes the cover plate 11 to incline, allowing the selected writing implement of desired color to drop onto the chuck.

It is unavoidable that particles and powder will be broken and worn from the color pencils (i.e., color leads) by friction while in use, and the amount of the powder in the cylindrical body will gradually increase. With transparent writing instruments, the lead powders can be seen from outside and therefore give an impression of foulness. They may enter the space in which the spring 8 is contained. Once they enter that space it cannot be removed without disassemblying the instrument. The powders in the spring space will have adverse effects on the operation of the chuck 5. The construction as illustrated in FIGS. 21 and 22 overcomes these drawbacks.

Figure 21:
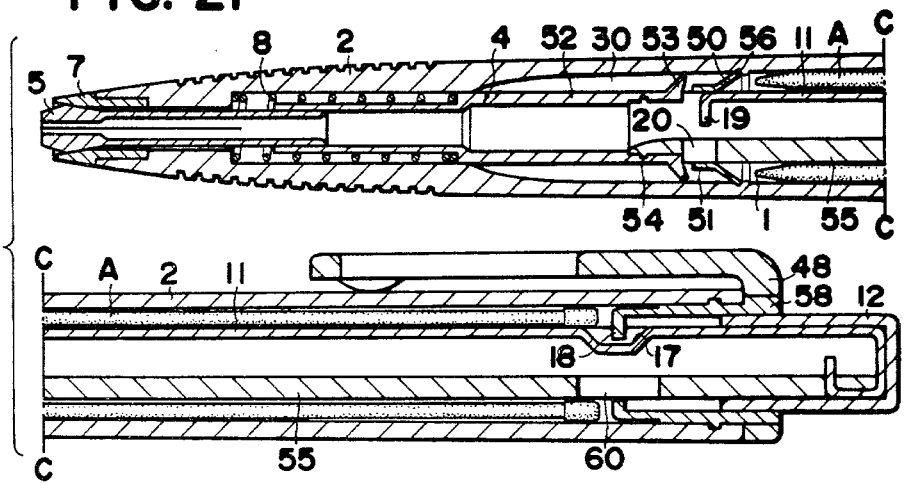
FIG. 21 is a cross-sectional view of a further embodiment of this invention.
Figure 22:
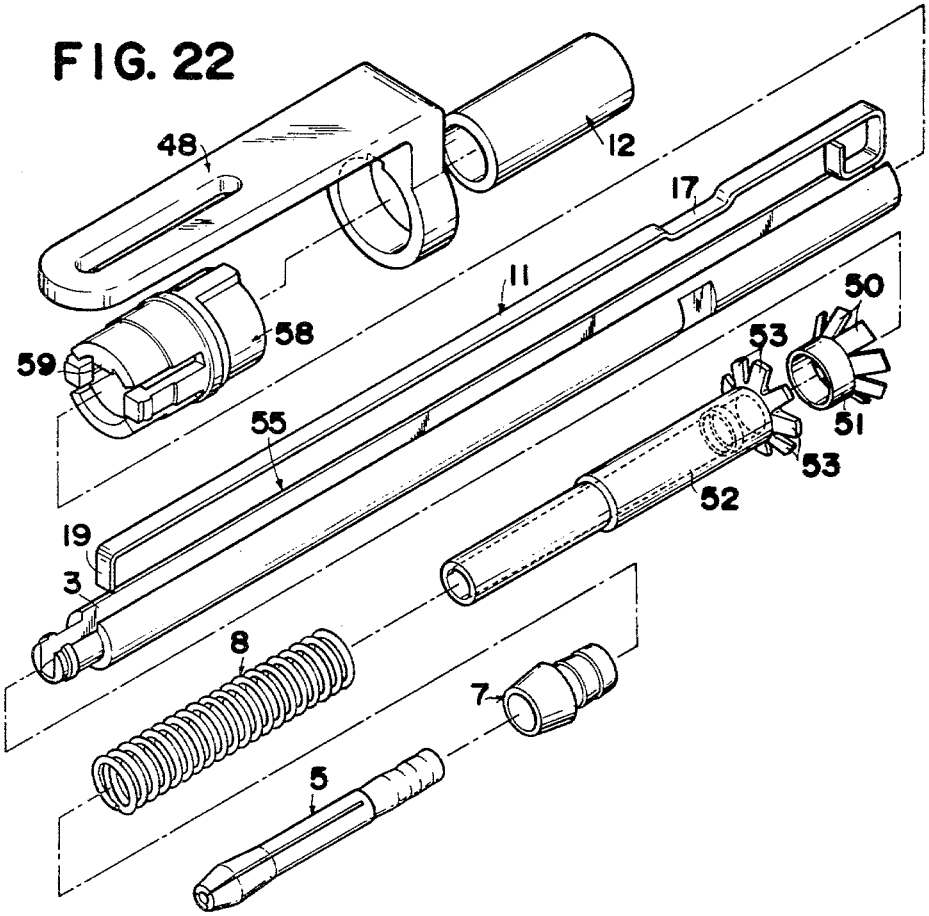
FIG. 22 is a perspective view of substantial elements of FIG. 21.

In FIGS. 21 and 22, fitted into the cylindrical body 2 at almost the middle thereof is a tube 51 with flared projections 50 each of which is sized to fit into the space between adjacent partition walls 30 (see FIG. 9) of the writing implement slots 1. Each of the flared projections constitutes the front wall of the writing instrument slot 1 which is defined by the partition walls 30 and which extends rearwardly from the flared projection. A front tube 52 that forms a portion of the guide tube 4 of FIGS. 1 through 20 is integrally formed with radially extending projections 53, each of which fits into the space defined by adjacent partition walls 30. The guide tube 4 consists of the front tube 52 having the chuck 5 secured to the front end and of a rear tube 55 rotatably connected to the front tube 52 by a connection as shown at 54. The cylindrical body 2 has formed in the inner surface thereof engagement grooves 56 for positioning the tube 51 with flared projections 50 and for holding the tube 51 against movement once it is set at a desired position.

The guide tube 4 arranged in the cylindrical body 2 is urged rearwardly by the spring 8 but is kept from slipping out from the writing instrument by the chuck 5 engaging with the metal tip 7 fitted at the front end of the cylindrical body 2. When the cap 12 fitted over the rear end of the guide tube 4 is pressed to advance the tube 4 against the spring 8, the chuck 5 opens by its own elasticity. The rear tube 55 forming the guide tube 4 has an opening 3 (refer to FIG. 4) which faces the opening of each slot 1. At the rear end of the opening 3, the cover plate 11 is supported by the cap 12 fitted over the rear end of the guide tube 4. In order to permit the cover plate 11 to align with the desired writing implement slot 1 by turning the clip 48, a breechblock 58 is rotatably connected to the rear end of the cylindrical body 2 and is provided with a projection 59 that engages with the opening 3, and the clip 48 is secured by an appropriate means. The depressed portion 17 of the cover plate 11 is the same as that described in FIGS. 1 through 3. That is, when the guide tube 4 is advanced against the force of the spring 8, the depressed portion 17 cooperates with the projection 59 of the breechblock 58 to tilt down the front end of the cover plate 11. Conversely, when the pressing force on the cap 12 is removed to allow the guide tube 4 to retract by the force of the spring 8, the aforementioned cooperative relationship is dissolved and the cover plate 11 returns to the position as shown in FIG. 21 by its own recovering force and closes the opening of the slot 1. The rear tube 55 has an opening 60 to receive the downwardly recessed portion 17 of the cover plate 11 when the cap 12 is taken out and the cover plate 11 falls. This makes it easy to insert the color lead A from the rear end of the writing instrument. Since the front end of the cover plate 11 is bent down (at 19) to prevent the color lead A from sliding under the cover plate 11, the rear tube 55 is provided with an opening 20 for feceiving the bent portion 19 when the cover plate 11 is tilted down.

As shown in FIG. 21, the flared projections 50 are inclined outwardly toward the rear to help the color writing implement A to drop smoothly by gravity, with the chuck 5 facing downward. The tube 51 is located such that is almost closes the opening 20 when the guide tube 4 of FIG. 21 is retracted to the rearmost position. This arrangement is to prevent the lead powders from entering the slots 1 through the opening 20. Because the guide tube 4 is advanced when the bent portion 19 the cover plate 11 is lowered and thrust into the opening 20, the bent portion 19 cannot abut against the tube 51 and cause damage to it. The projections 53 of the front tube 52 also are inclined in the same direction as that of the flared projections 50. The purpose of the projections 53 is to collect the lead powders toward the opening 20. The collected powders are discharged through the front tube 52 and out from the chuck 5 every time the bent portion 19 of the cover plate 11 moves up. This prevents the powders from obstructing the smooth action of the chuck 5.

Although there have been described only the preferred embodiments, it should be noted that this invention is not limited to the foregoing embodiments and that various modifications may be made thereto within the scope of the appended claims.

What is claimed is:

1. A multiple slot writing instrument comprising:

a cylindrical body having in an internal surface thereof a plurality of longitudinally extending slots for containing a plurality of writing instruments;

a guide tube fitted within said cylindrical body for rotation and axial movement relative thereto, said guide tube having therethrough a single longitudinally extending opening adapted to be aligned with a selected one of said slots upon rotation of said guide tube with respect to said cylindrical body, whereby a respective writing implement is transferrable through said opening between said selected slot and the interior of said guide tube;

chuck means positioned at a front end of said guide tube for gripping a writing implement within said guide tube;

a cover plate positioned adjacent said opening in said guide tube, said cover plate being tiltably movable between a blocking first position blocking said opening and an unblocking second position unblocking said opening;

cap means mounted on a rear end of said cylindrical body for moving said guide tube and said cover plate axially with respect to said cylindrical body from a closed first position toward a released second position; and means for, upon axial movement of said guide tube and cover plate from said first closed position thereof toward said released second position thereof, tilting said cover plate from said blocking first position thereof to said unblocking second position thereof, said tilting means comprising a projecting member rotatably mounted to a rear portion of said cylindrical body, said projecting member having a projection extending inwardly through said opening, and engagement means in the form of a depressed portion in said cover plate at a position such that said projection engages said depressed portion when said guide tube and cover plate are in said first closed position thereof and engages an undepressed portion of said cover plate when said guide tube and cover plate are moved toward said released second position thereof.

2. A writing instrument as claimed in claim 1, wherein said projecting member is rotatably fit in a groove formed in the inner surface of said rear portion of said cylindrical body.

3. A writing instrument as claimed in claim 1, further comprising leaf spring means for imparting a recovery force to said cover plate tending to urge said cover plate to said blocking first position thereof, said leaf spring means including a depressed portion located to receive said depressed portion of said cover plate, and said guide tube having therein an opening to receive said depressed portions of said cover plate and said leaf spring means.

4. A multiple slot writing instrument comprising:

a cylindrical body having in an internal surface thereof a plurality of longitudinally extending slots for containing a plurality of writing instruments;

a guide tube fitted within said cylindrical body for rotation and axial movement relative thereto, said guide tube having therethrough a single longitudinally extending opening adapted to be aligned with a selected one of said slots upon rotation of said guide tube with respect to said cylindrical body, whereby a respective writing implement is transferrable through said opening between said selected slot and the interior of said guide tube;

chuck means positioned at a front end of said guide tube for gripping a writing implement within said guide tube;

a cover plate positioned adjacent said opening in said guide tube, said cover plate being tiltably movable between a blocking first position blocking said opening and an unblocking second position unblocking said opening;

cap means mounted on a rear end of said cylindrical body for moving said guide tube and said cover plate axially with respect to said cylindrical body from a closed first position toward a released second position; and means for, upon axial movement of said guide tube and cover plate from said closed first position thereof toward said released second position thereof, tilting said cover plate from said blocking first position thereof to said unblocking second position thereof, said tilting means comprising an annular projecting member formed integrally with said cylindrical body, said projecting member having an inwardly extending projection maintained exteriorly of said opening, and engagement means in the form of a raised portion of said cover plate at a position such that said projection engages an unraised portion of said cover plate when said guide tube and cover plate are in said closed first position thereof and engages said raised portion when said guide tube and cover plate are moved toward said released second position thereof.

5. A writing instrument as claimed in claim 4, wherein said cylindrical body includes a front body portion and a rear body portion rotatably connected to said front body portion, and said guide tube is secured to said front body portion.

6. A writing instrument as claimed in claim 1 or claim 4, wherein said cover plate has a front end including a bent portion and a rear end including an arm portion rested within said cap means, said guide tube has therein openings located to receive therethrough said bent portion when said cover plate is tilted to said unblocking second position thereof, and said cylindrical body has receiver chambers for receiving said bent portion when said cover plate is tilted to said unblocking second position thereof.

7. A writing instrument as claimed in claim 1 or 4, further comprising means for enabling rotation of said guide tube with respect to said cylindrical body when said guide tube is in said closed first position and for preventing such rotation when said guide tube is axially moved away from said closed first position, said means comprising sub-partition walls formed on the inner surface of said cylindrical body at positions aligned with corresponding partition walls defining said slots, an annular control member rotatably fitted between said sub-partition walls and said guide tube, said control member having at least one radially flexible movable member having on an external surface thereof a raised portion fitting between adjacent said sub-partition walls, and said guide tube having in the external surface thereof an engagement groove at a position such that when said guide tube is in said closed first position thereof said movable member is totally axially aligned with said engagement groove, whereby said movable member is movable inwardly into said engagement groove and said raised portion can ride over said sub-partition walls, thereby enabling rotation of said guide tube with respect to said cylindrical body, and such that when said guide tube is moved away from said closed first position thereof said movable member is not totally axially aligned with said engagement groove, whereby said movable member is not movable inwardly into said engagement groove and said raised portion is prevented from riding over said sub-partition walls, thereby preventing rotation of said guide tube with respect to said cylindrical body.

8. A writing instrument as claimed in claim 7, wherein said control member is rotatably fitted to the rear end of said cylindrical body, functions as a breechblock and has a projection extending into said guide tube.

9. A writing instrument as claimed in claim 8, wherein said cylindrical body includes a front body portion and a rear body portion rotatably connected to said front body portion, said sub-partition walls are formed on the front end of the inner surface of said rear body portion, and said control member is fixed to the rear end of said front body portion.

10. A writing instrument as claimed in claim 1 or claim 4, wherein said guide tube has therein substantially U-shaped slits forming elastic portions, each said elastic portion having an outwardly extending projection, said cylindrical body includes a front body portion and a rear body portion rotatably connected to said front body portion, said rear body portion having therethrough a plurality of holes aligned with said slots, said projections adapted to engage said holes in said rear body portion to align said opening in said guide tube with a selected said slot.

11. A multiple slot writing instrument comprising:

a cylindrical body having in an internal surface thereof a plurality of longitudinally extending slots for containing a plurality of writing instruments;

a guide tube fitted within said cylindrical body for rotation and for axial movement relative thereto, said guide tube having therethrough a single longitudinally extending opening adapted to be aligned with a selected one of said slots upon rotation of said guide tube with respect to said cylindrical body, whereby a respective writing implement is transferrable through said opening between said selected slot and the interior of said guide tube;

chuck means positioned at a front end of said guide tube for gripping a writing implement within said guide tube;

a cover plate positioned adjacent said opening in said guide tube, said cover plate being tiltably movable between a blocking first position blocking said opening and an unblocking second position unblocking said opening;

cap means mounted on a rear end of said cylindrical body for moving said guide tube and said cover plate axially with respect to said cylindrical body from a closed first position toward a released second position; and means for enabling rotation of said guide tube with respect to said cylindrical body when said guide tube is in said closed first position and for preventing such rotation when said guide tube is axially moved away from said closed first position, said means comprising sub-partition walls formed on the inner surface of said cylindrical body at positions aligned with corresponding partition walls defining said slots, an annular control member rotatably fitted to the rear end of said cylindrical body and extending between said sub-partition walls and said guide tube, said control member functioning as a breechblock and having a projection extending into said guide tube, said control member having at least one radially flexible movable member having on an external surface thereof a raised portion fitting between adjacent said sub-partition walls, and said guide tube having in the external surface thereof an engagement groove at a position such that when said guide tube is in said closed first position thereof said movable member is totally axially aligned with said engagement groove, whereby said movable member is movable inwardly into said engagement groove and said raised portion can ride over said sub-partition walls, thereby enabling rotation of said guide tube with respect to said cylindrical body, and such that when said guide tube is moved away from said closed first position thereof said movable member is not totally axially aligned with said engagement groove, whereby said movable member is not movable inwardly into said engagement groove and said raised portion is prevented from riding over said sub-partition walls, thereby preventing rotation of said guide tube with respect to said cylindrical body.

12. A multiple slot writing instrument comprising:

a cylindrical body having in an internal surface thereof a plurality of longitudinally extending slots for containing a plurality of writing instruments;

a guide tube fitted within said cylindrical body for rotation and for axial movement relative thereto, said guide tube having therethrough a single longitudinally extending opening adapted to be aligned with a selected one of said slots upon rotation of said guide tube with respect to said cylindrical body, whereby a respective writing implement is transferrable through said opening between said selected slot and the interior of said guide tube;

chuck means positioned at a front end of said guide tube for gripping a writing implement within said guide tube;

a cover plate positioned adjacent said opening in said guide tube, said cover plate being tiltably movable between a blocking a first position blocking said opening and an unblocking second position unblocking said opening;

cap means mounted on a rear end of said cylindrical body for moving said guide tube and said cover plate axially with respect to said cylindrical body from a closed first position toward a released second position;

said cylindrical body including a front body portion and a rear body portion rotatably connected to said front body portion; and means for enabling rotation of said guide tube with respect to said front body portion when said guide tube is in said closed first position and for preventing such rotation when said guide tube is axially moved away from said closed first position, said means comprising sub-partition walls formed on the front end of the inner surface of said rear body portion at positions aligned with corresponding partition walls defining said slots, an annular control member fixed to the rear end of said front body portion and extending between said sub-partition walls and said guide tube, said control member having at least one radially flexible movable member having on an external surface thereof a raised portion fitting between adjacent sub-partition walls, and said guide tube having in the external surface thereof an engagement groove at a position such that when said guide tube is in said closed first position thereof said movable member is totally axially aligned with said engagement groove, whereby said movable member is movable inwardly into said engagement groove and said raised portion can ride over said sub-partition walls, thereby enabling rotation of said guide tube with respect to said front body portion, and such that when said guide tube is moved away from said closed first position thereof said movable member is not totally axially aligned with said engagement groove, whereby said movable member is not movable into said engagement groove and said raised portion is prevented from riding over said sub-partition walls, thereby preventing rotation of said guide tube with respect to said from body portion.

13. A multiple slot writing instrument comprising:

a cylindrical body having in an internal surface thereof a plurality of longitudinally extending slots for containing a plurality of writing instruments;

a guide tube fitted within said cylindrical body for rotation and for axial movement relative thereto, said guide tube having therethrough a single longitudinally extending opening adapted to be aligned with a selected one of said slots upon rotation of said guide tube with respect to said cylindrical body, whereby a respective writing implement is transferrable through said opening between said selected slot and the interior of said guide tube;

chuck means positioned at a front end of said guide tube for gripping a writing implement within said guide tube;

a cover plate positioned adjacent said opening in said guide tube, said cover plate being tiltable movable between a blocking first position blocking said opening and an unblocking second position unblocking said opening;

cap means mounted on a rear end of said cylindrical body for moving said guide tube and said cover plate axially with respect to said cylindrical body from a closed first position toward a released second position;

leaf spring means for imparting a recovery force to said cover plate tending to urge said cover plate to said blocking first position thereof;

said guide tube and said leaf spring means having bent base portions;

said guide tube having adjacent the rear end thereof, in a side thereof opposite said opening, opening means for receiving therethrough said base portions; and said base portions extending through said opening means and being held between said guide tube and said cap means.

14. A writing instrument as claimed in claim 13, wherein said opening means comprises a single opening receiving therethrough both said base portions.

15. A writing instrument as claimed in claim 13, wherein said opening means comprises two separate openings each receiving therethrough a respective said base portion.

16. A writing instrument as claimed in claim 13, further comprising a ring slidably fitted in a groove in an inner surface of said cap means, said ring supporting said base portion of said leaf spring means.

17. A multiple slot writing instrument comprising:

a cylindrical body having in an internal surface thereof a plurality of longitudinally extending partition walls defining slots for containing a plurality of writing instruments;

a guide tube fitted within said cylindrical body for rotation and axial movement relative thereto, said guide tube having therethrough a single longitudinally extending opening adapted to be aligned with a selected one of said slots upon rotation of said guide tube with respect to said cylindrical body, whereby a respective writing implement is transferrable through said opening between said selected slot and the interior of said guide tube;

chuck means positioned at a front end of said guide tube for gripping a writing implement within said guide tube;

a cover plate positioned adjacent said opening in said guide tube, said cover plate being tiltably movable between a blocking first position blocking said opening and an unblocking second position unblocking said opening;

cap means mounted on a rear end of said cylindrical body for moving said guide tube and said cover plate axially with respect to said cylindrical body from a closed first position toward a released second position;

said guide tube including a front tube portion and a rear tube portion rotatably connected to said front tube portion, said front tube portion having first projections slidably fitted between adjacent said partition walls, said rear tube portion having therein openings; and said cylindrical body having a tubular body at a position between said front and rear tube portions, said tubular body including outwardly extending second projections fitted between adjacent said partition walls at locations to close said openings in said rear tube portion when said guide tube is in said closed first position thereof.

18. A writing instrument as claimed in claim 13 or claim 17, wherein said cover plate has a front end including a bent portion and a rear end including an arm portion nested within said cap means.

19. A writing instrument as claimed in claim 18, further comprising a projecting member disposed at the rear end of said cylindrical body and projecting inwardly, engagement means on said cover plate to be engaged by said projecting member to tilt said cover plate to said unblocking second position, openings in said guide tube to receive therethrough said bent portion when said cover plate is tilted to said unblocking second position thereof, and receiver chambers in said cylindrical body for receiving therethrough said bent portion when said cover is tilted to said unblocking second position thereof.

20. A writing instrument as claimed in claim 1, claim 4, claim 11, claim 12, claim 13 or claim 17, wherein said cylindrical body is formed of a transparent material.

* * * * *